US011198570B2

(12) United States Patent
Monti

(10) Patent No.: US 11,198,570 B2
(45) Date of Patent: Dec. 14, 2021

(54) TRANSFER DEVICE FOR TRANSFERRING FLAT BOXES CONTAINED INFERNALLY OF A CARTON TO AN INLET LINE OF A BOXING MACHINE

(71) Applicant: MARCHESINI GROUP S.p.A., Pianoro (IT)

(72) Inventor: Giuseppe Monti, Pianoro (IT)

(73) Assignee: MARCHESINI GROUP S.P.A., Pianoro (IT)

( * ) Notice: Subject to any disclaimer, the term of this patent is extended or adjusted under 35 U.S.C. 154(b) by 0 days.

(21) Appl. No.: 16/642,247

(22) PCT Filed: Sep. 7, 2018

(86) PCT No.: PCT/IB2018/056830

§ 371 (c)(1),
(2) Date: Feb. 26, 2020

(87) PCT Pub. No.: WO2019/049075

PCT Pub. Date: Mar. 14, 2019

(65) Prior Publication Data

US 2020/0369481 A1 Nov. 26, 2020

(30) Foreign Application Priority Data

Sep. 11, 2017 (IT) ..... 102017000101123

(51) Int. Cl.
*B65H 1/30* (2006.01)
*B65B 43/12* (2006.01)
*B65H 5/00* (2006.01)

(52) U.S. Cl.
CPC ..... *B65H 1/30* (2013.01); *B65B 43/126* (2013.01); *B65H 5/006* (2013.01);
(Continued)

(58) Field of Classification Search
CPC ..... B65H 1/30; B65H 5/006; B65H 2801/81; B65H 2405/52; B65H 2701/176; B65B 43/126
(Continued)

(56) References Cited

U.S. PATENT DOCUMENTS 2,696,334 A * 12/1954 Rhodes ..... A21C 9/081 53/74
2,843,983 A * 7/1958 Archer ..... A21C 9/081 53/74
(Continued)

FOREIGN PATENT DOCUMENTS

EP 0528772 A1 2/1993
EP 2671808 A1 12/2013
WO WO 03/045825 A1 6/2003

*Primary Examiner* — Lynn E Schwenning
(74) *Attorney, Agent, or Firm* — R. Neil Sudol; Henry D. Coleman

(57) ABSTRACT

A transfer device raises batteries of flat boxes inside a carton so that one battery at a time is in a waiting position beyond an open upper face of the carton at an inlet line of a boxing machine. A frame is predisposed to translate above the positioning station and the inlet line between a first position above the waiting position and a second position above the inlet line. Grippers on the frame both grip and retain a box battery at two ends thereof and release the battery. The grippers are activated, with the frame in the first position, to grip and retain the battery of boxes at its two ends and, with the frame in the second position, to release the battery into the inlet line.

9 Claims, 12 Drawing Sheets

(52) U.S. Cl.
CPC .... *B65H 2405/52* (2013.01); *B65H 2701/176* (2013.01); *B65H 2801/81* (2013.01)

(58) Field of Classification Search
USPC ..... 414/794.4
See application file for complete search history.

(56) References Cited

U.S. PATENT DOCUMENTS

| | | | | | |
|---|---|---|---|---|---|
| 2,957,287 | A * | 10/1960 | Cella | B65B 5/065 | 53/64 |
| 4,154,043 | A * | 5/1979 | Heide | B65B 35/24 | 53/245 |
| 4,974,391 | A * | 12/1990 | Blum | B65B 5/068 | 53/69 |
| 4,984,677 | A * | 1/1991 | Prakken | B65B 5/101 | 198/418.6 |
| 5,067,303 | A * | 11/1991 | Brookman | B65B 69/00 | 53/381.2 |
| 6,241,458 | B1 * | 6/2001 | Berndl | B65G 57/11 | 414/790.3 |
| 6,357,202 | B1 * | 3/2002 | Bauer | B65B 43/126 | 53/202 |
| 6,574,943 | B2 * | 6/2003 | Van Dam | B65B 5/061 | 414/790.3 |
| 7,128,520 | B2 * | 10/2006 | Monti | B65B 35/50 | 414/794.2 |
| 2013/0319906 | A1 * | 12/2013 | Monti | B65D 5/503 | 206/703 |

* cited by examiner

TRANSFER DEVICE FOR TRANSFERRING FLAT BOXES CONTAINED INFERNALLY OF A CARTON TO AN INLET LINE OF A BOXING MACHINE

FIELD OF THE INVENTION

The present invention relates to the technical sector concerning the packaging of articles internally of relative boxes, and in particular to the packaging of blister packs, containing pharmaceutical/parapharmaceutical products, inside relative boxes.

DESCRIPTION OF THE PRIOR ART

To carry out these packaging operations, use is made of automatic and/or semi-automatic machines, known as boxing machines, which are provided with an inlet line in which the flat boxes are to be positioned, flanked and side-by-side in contact with one another in a continuous line, which flat boxes will then be advanced and directed towards other work stations of the same machines where the boxes will be opened-out into full volume so as to be able to receive, internally thereof, the blister packs, and obtain the final packaging.

The inlet lines of the boxing machines usually comprises a receiving and advancing channel of the flat boxes comprising two lateral containing walls, between which the flat boxes are to be positioned, arranged transversally to said lateral walls, and advancing means of the boxes, which serve to advance the boxes once they have been predisposed between the two lateral walls.

Boxing machines also comprise infeed lines of the blister packs which are to be inserted in the opened-out boxes to full volume, which infeed lines are arranged flanked to the inlet line which receives the boxes in a flat configuration.

The flat boxes are predisposed internally of cardboard packages which can have the particular conformation as illustrated in FIGS. 1A, 1B.

These packs (Z) comprise a carton (C) which is provided with a base wall (CB) which has a series of through-holes (F) (visible in FIG. 1B) and, internally of the carton (C), a series of batteries (B) of flat boxes which are arranged one above another.

In each battery (B), the flat boxes are predisposed flanked and side-by-side in contact with respect to one another to form a continuous line.

The carton (C) pack (Z) further comprises a series of containing flaps (U) of the batteries (B) of boxes, made of cardboard or card, which have a U shape (see for example FIG. 1A).

Each containing flap (U) has the function of containing and supporting a relative battery (B) of boxes internally of the carton, and enveloping the battery (B) at least up to the two ends (B1, B2) thereof.

In this regard, each containing flap (U) has a base, having an extension at least equal to the length of the battery (B) of boxes, and two end tabs (U1, U2), folded in an upwards direction with respect to the base about respective score lines, in order to abut the two ends (B1, B2) of the battery (B) of boxes and maintain the boxes of the battery compact with respect to one another when the battery is arranged internally of the carton (C).

In particular, the present invention relates to a transfer device for transferring flat boxes contained internally of a carton, in particular a carton as described in the foregoing, to an inlet line of a boxing machine.

In this particular sector, there is a need to extract the various batteries of flat boxes from the relative cartons and to transfer them to the inlet line of the boxing machine in an entirely automatic and rapid way and, without having recourse to manual operations which must be carried out by an operator, while at the same time, during the transfer and the positioning of the batteries of boxes in the inlet line, maintaining the batteries of flat boxes perfectly compact with one another, without their being able to fold, and with the boxes arranged with the correct orientation.

SUMMARY OF THE INVENTION

The aim of the present invention is therefore to disclose a transfer device for carrying out transfer of boxes contained internally of a carton at the inlet line of a boxing machine, able to satisfy the above-specified requirements.

This aim is obtained in accordance with a transfer device of claim 1.

Further advantageous characteristics of the transfer device of the present invention are set down in the various claims dependent on claim 1.

Another aim of the present invention is also to provide a boxing machine having a particular lay-out so as to be able to effectively use the transfer device of claim 1, and the relative dependent claims, with regard both to ergonomic requirements and safety requirements for the operators tasked with control of regular functioning thereof.

BRIEF DESCRIPTION OF THE DRAWINGS

The characteristics of a preferred, but not exclusive, embodiment of the transfer device for transfer of flat boxes contained internally of a carton to the inlet line of a boxing machine, and the lay-out of a boxing machine using the device, proposed by the present invention, are described in the following with reference to the appended tables of drawings, in which.

DESCRIPTION OF THE PREFERRED EMBODIMENTS

With reference to the accompanying tables of drawings, reference letter (D) relates to an infeed device of an inlet line (LA) of a boxing machine (MA) with flat boxes contained internally of a carton (C).

The inlet lines (LA) of the boxing machines usually comprise a conveying channel for flat boxes which is provided with lateral walls (L1, L2) for containing the flat boxes during transfer thereof, and conveying means, for example constituted by belts (7), for advancing the flat boxes (A) towards successive stations for opening out the boxes to full volume and for filling them with the blister packs.

The transfer device (D) of the invention comprises a positioning station (1) of a carton (C), predisposed for receiving a carton (C) with the relative upper face (I) open and internally containing flat boxes (A).

Figure 1A:
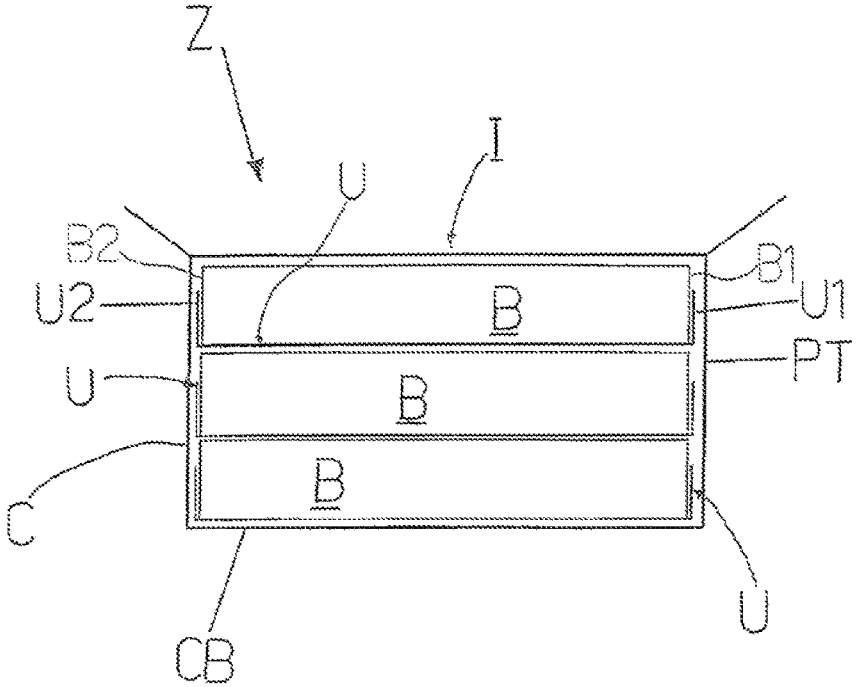
FIG. 1A, mentioned in the foregoing, illustrates, in a vertical transversal section, the conformation of a cardboard pack containing batteries of flat boxes which are to be transferred to the inlet line of a boxing machine, while FIG. 1B, also mentioned in the foregoing, illustrates, in a view from above, the empty carton and with the upper face open so as to enable viewing of the holes present in the relative base wall.
Figure 1B:
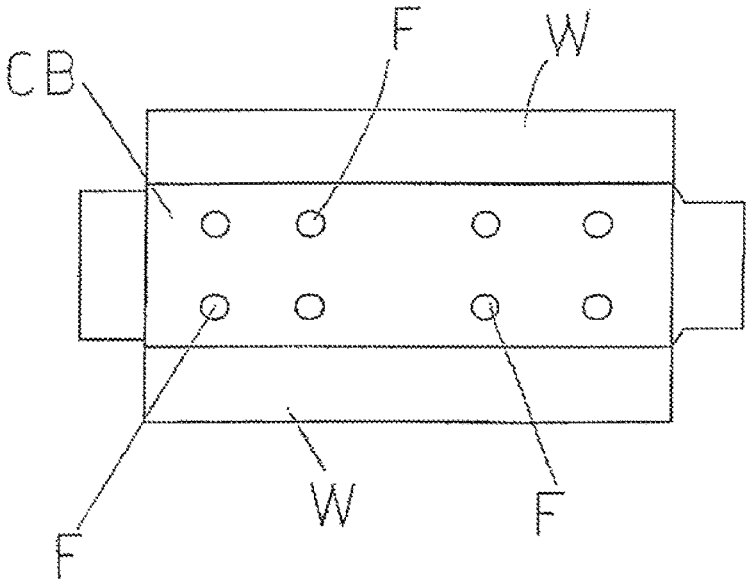
FIG. 1C schematically illustrates, in a view from above, a possible embodiment of a containing flap of the batteries of boxes utilisable for realising the cardboard pack of FIG. 1A.

As previously mentioned, the flat boxes (A) are predisposed, neared and flanked to one another, to form batteries (B) of boxes which are arranged one above another internally of the carton (C) and each contained internally of a relative containing flap or support sheet (U) (see FIGS. 1A and 1B once more).

Each containing flap or support sheet (U) has the function of containing, and supporting a relative battery (B) of boxes internally of the carton, and enveloping the battery (B) at least up to the two ends (B1, B2).

In this regard, each containing flap or support sheet (U) has a base, having an extension at least equal to the length of the battery (B) of boxes, and two end tabs (U1, U2), folded in an upwards direction with respect to the base about respective score lines, in order to abut the two ends (B1, B2) of the battery (B) of boxes and maintain the boxes of the battery compact with respect to one another when the battery is arranged internally of the carton.

Figure 1C:
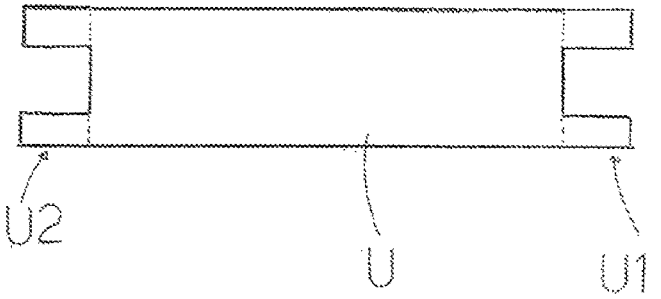
Figure 2A:
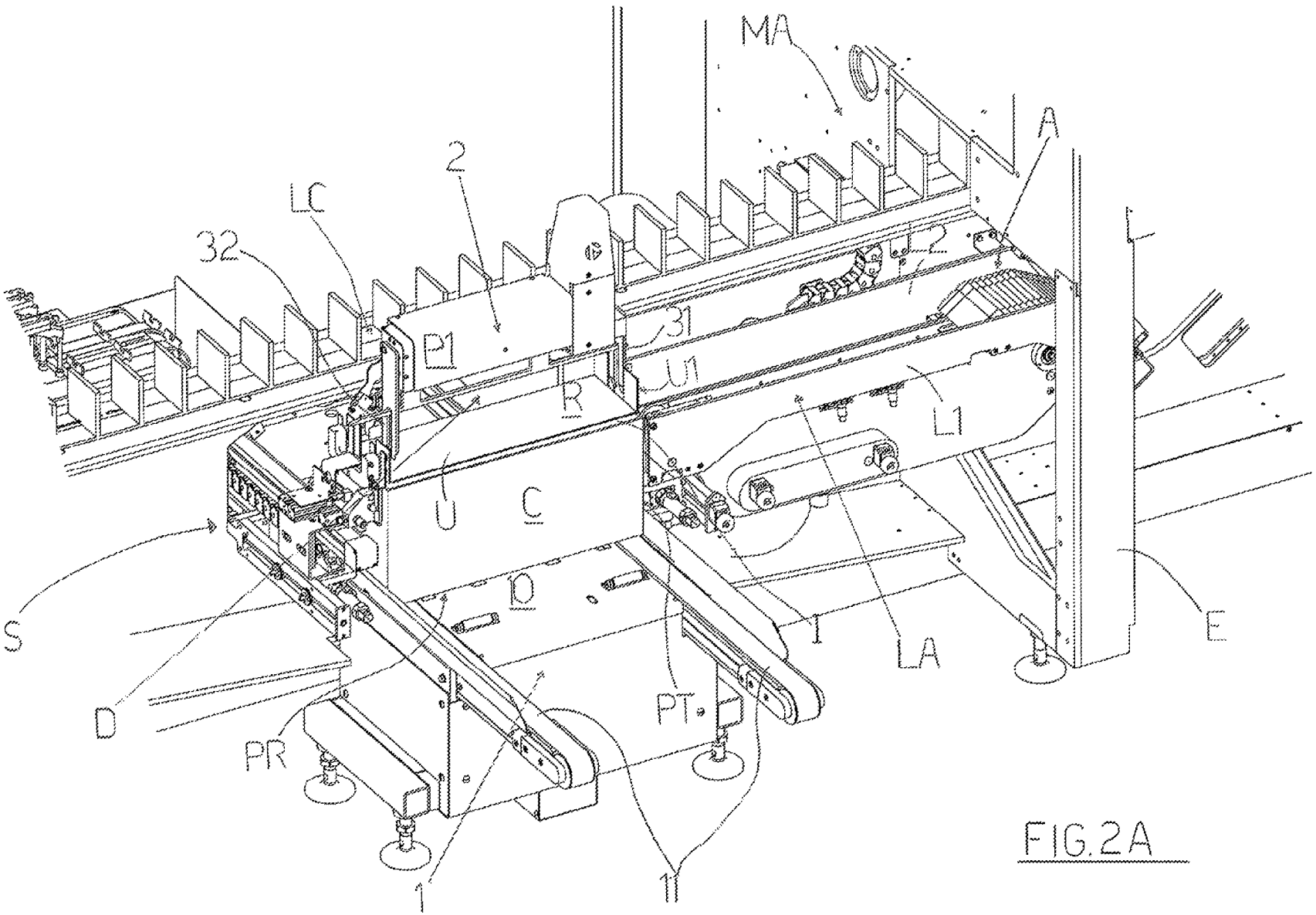
FIG. 2A illustrates, in a schematic perspective view, the transfer device of the present invention, together with the particular lay-out of a boxing machine, only partially illustrated, as concerning the reciprocal positioning of the inlet line of the boxes and the infeed line of the blister packs, which utilises the transfer device of the invention; this figure also illustrates a cardboard pack containing batteries of flat boxes predisposed in a position facing and in front of the inlet line of the boxing machine in order to enable the transfer operations of the batteries of boxes from the carton to the inlet line.
Figure 2B:
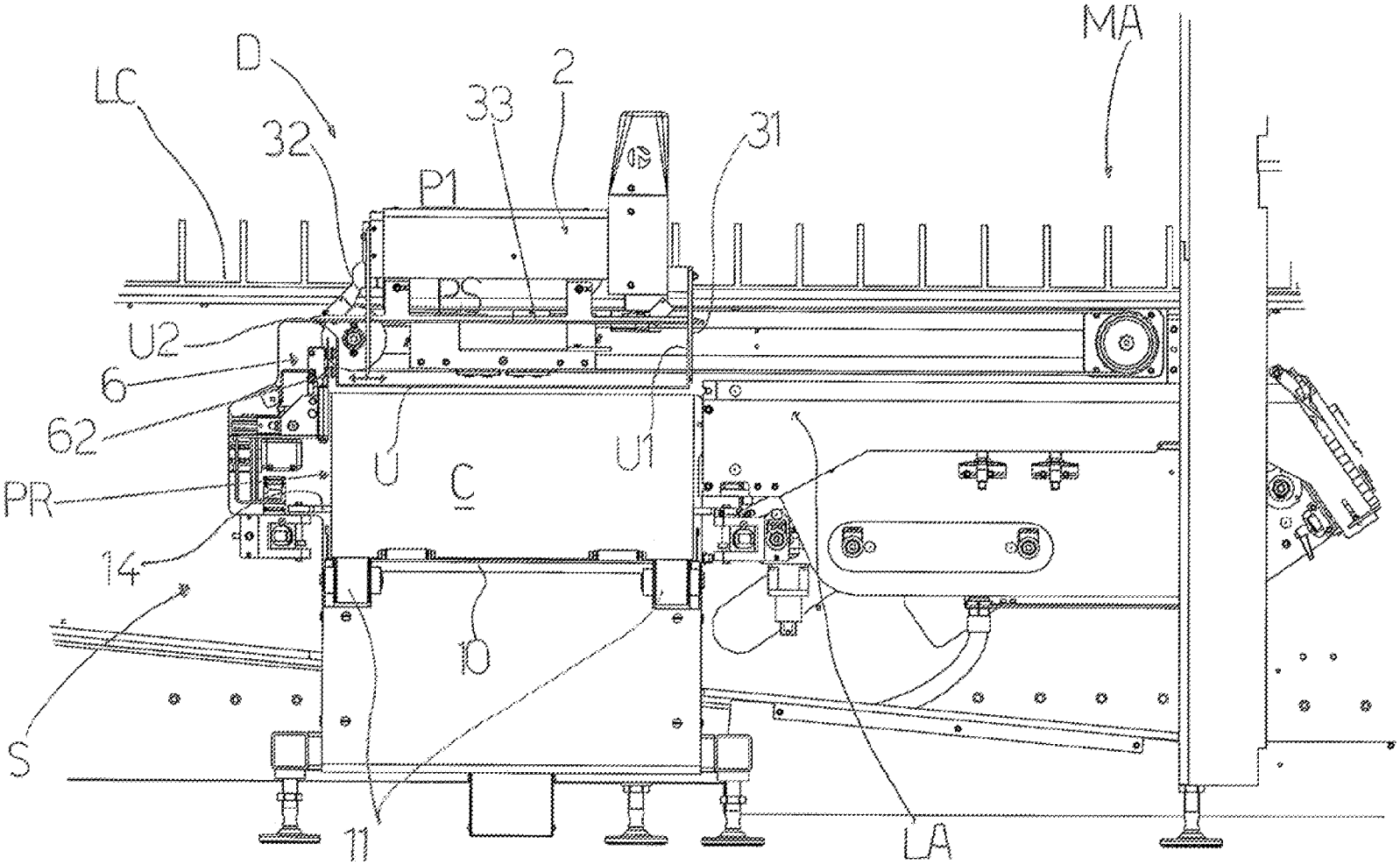
FIG. 2B is a front view of FIG. 2A.
Figure 2C:
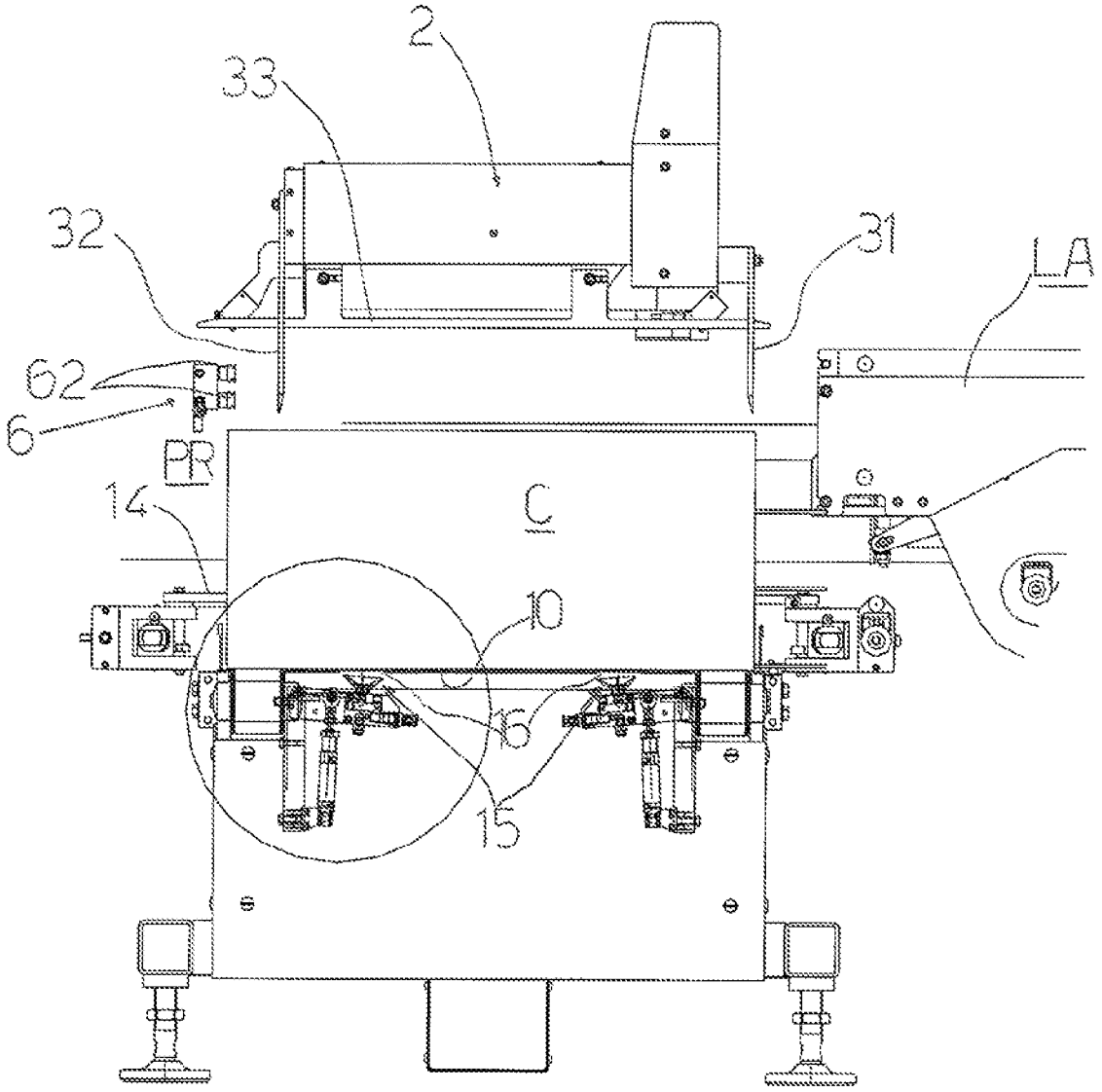
FIG. 2C is the view of FIG. 2B, with some parts removed better to view other special components of the transfer device.

Each tab (U1, U2) of the containing flap or support sheet (U) preferably has a window/central cut (see FIG. 1C).

The positioning station (1) of the transfer device is predisposed with respect to the inlet line (LA) of the boxing machine (MA) so as to receive the carton (C) and to halt the carton (C) in a halted position (PR) with a relative transversal wall (PT) facing towards the inlet line (LA) and with the open upper face (I) in front of and substantially at a same level as a start of an inlet line (LA) (see for example FIGS. 2A, 2C, 4A, 4B)

Figure 3A:
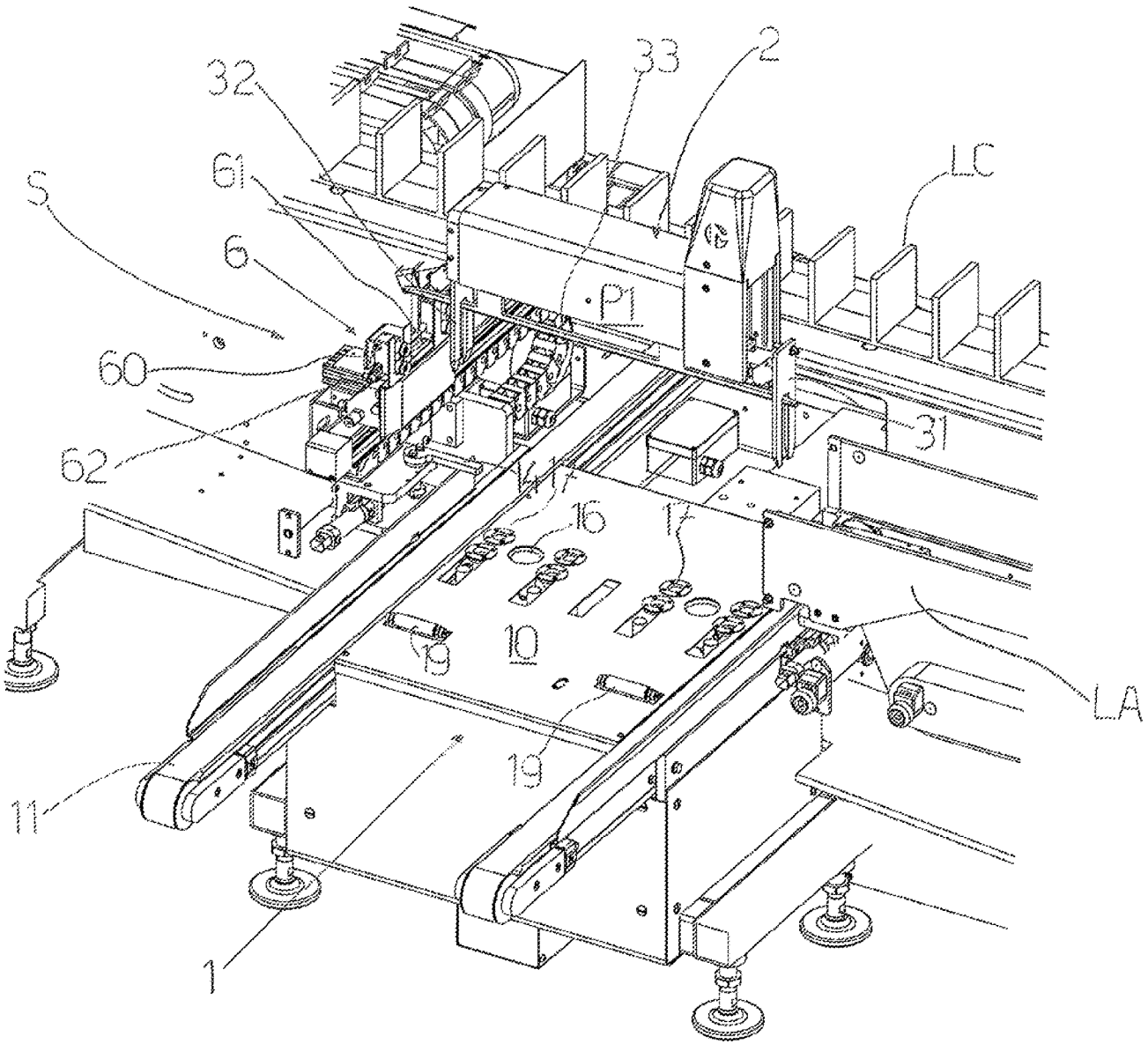
FIGS. 3A, 3B and 3C are schematic perspective views of the transfer device of the present invention in successive operating configurations during the transfer of batteries of boxes from cardboard packs to the inlet line of a boxing machine.
Figure 3B:
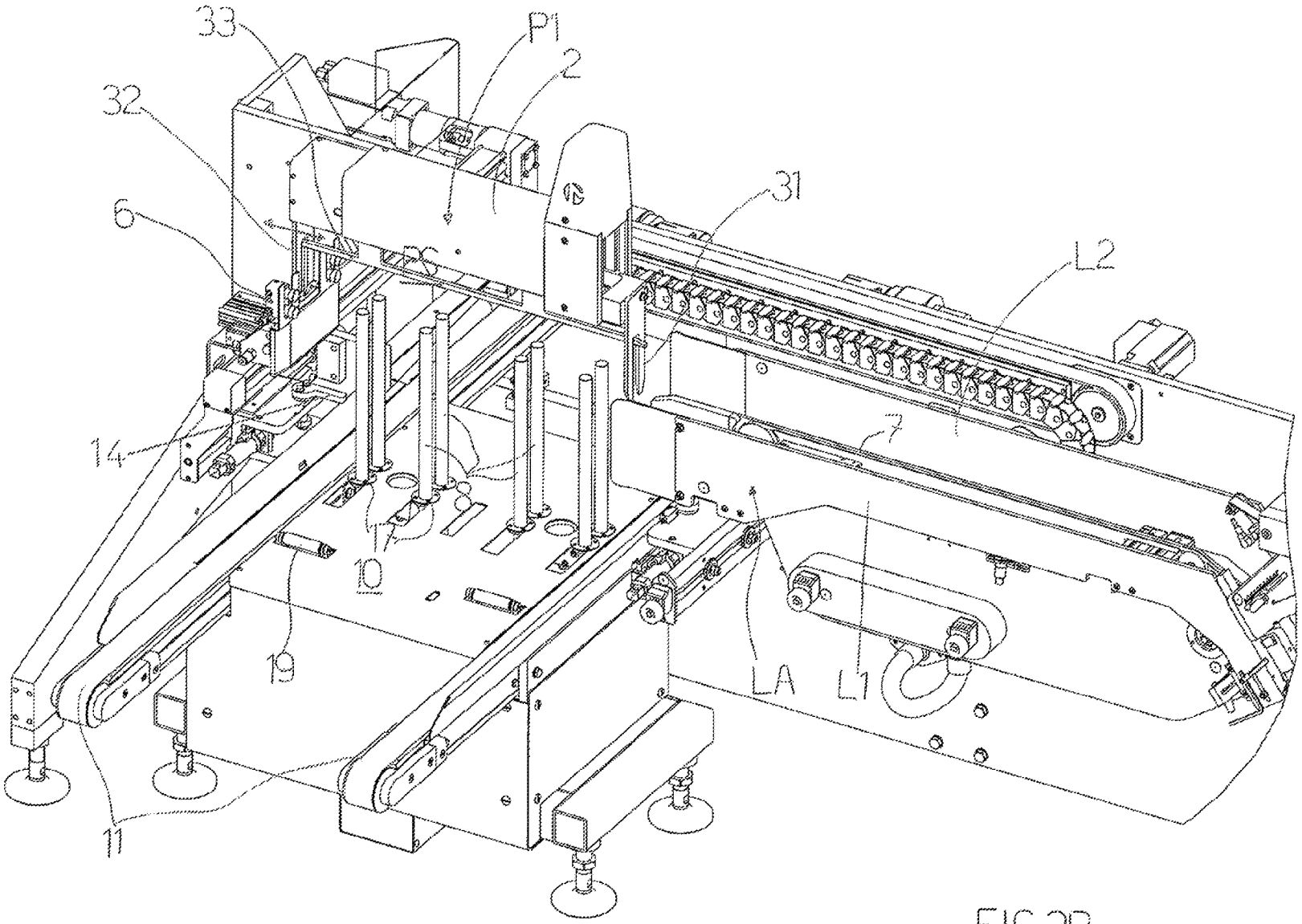
Figure 4A:
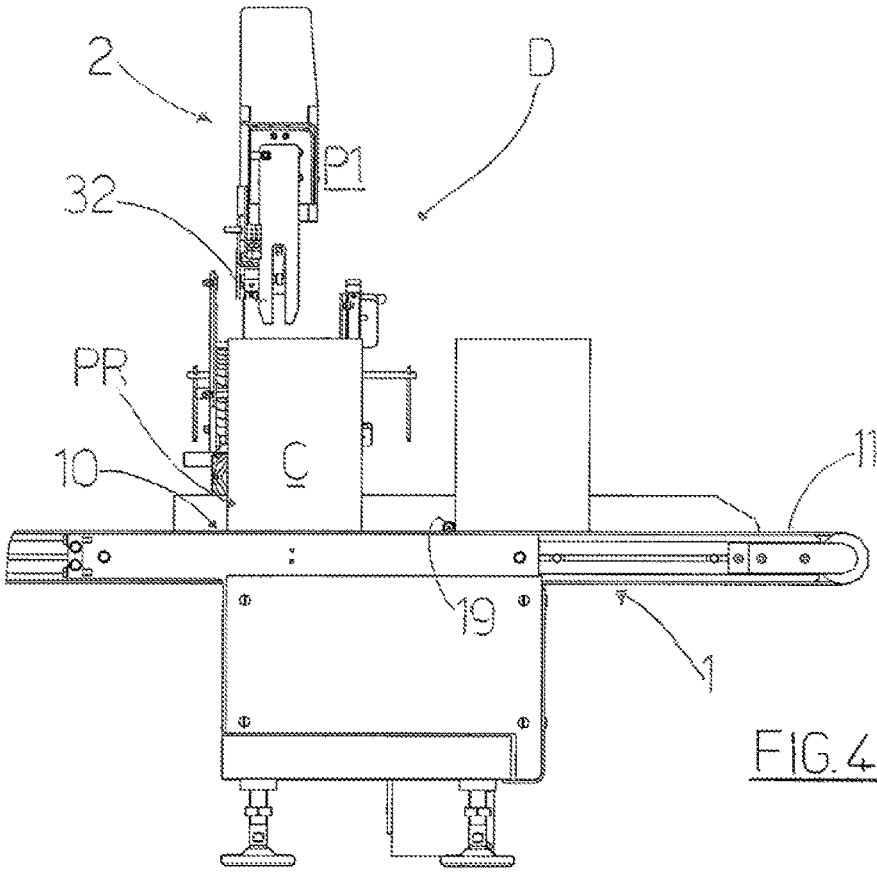
FIGS. 4A to 4G are respective schematic views of a sequence of operating steps carried out by the transfer device of the present invention in order to transfer a battery of boxes of boxes present internally of a cardboard pack to the inlet line of a boxing machine.
Figure 4B:
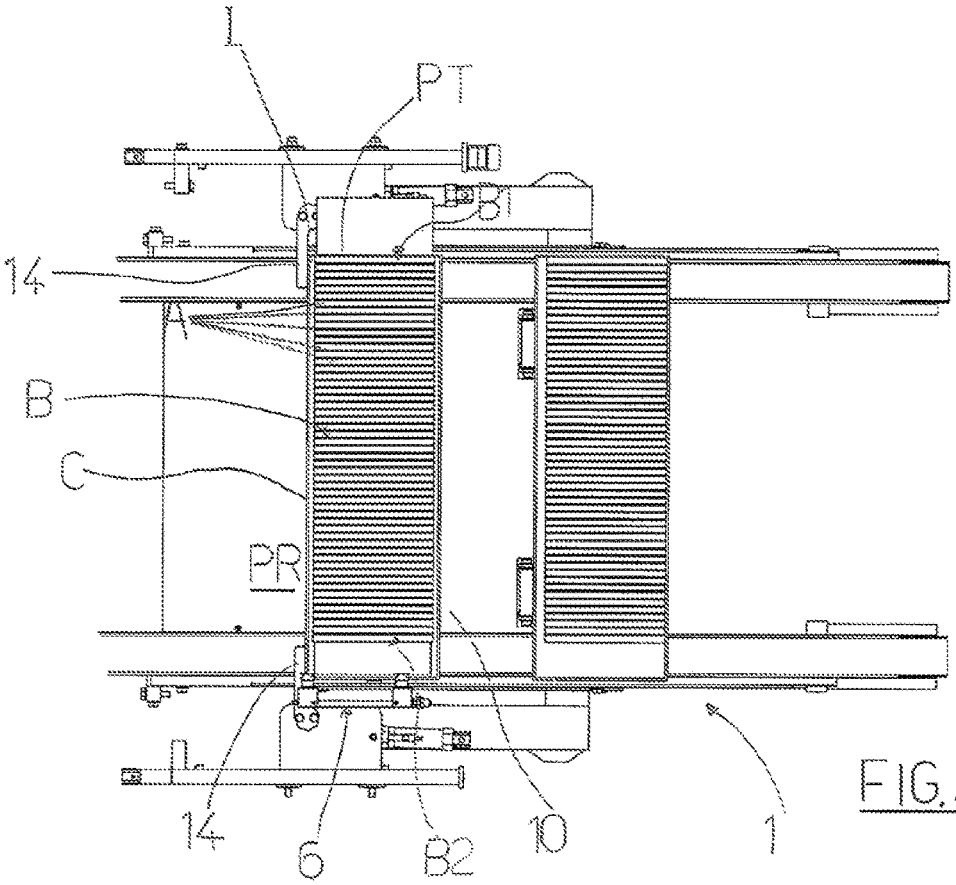
Figure 4D:
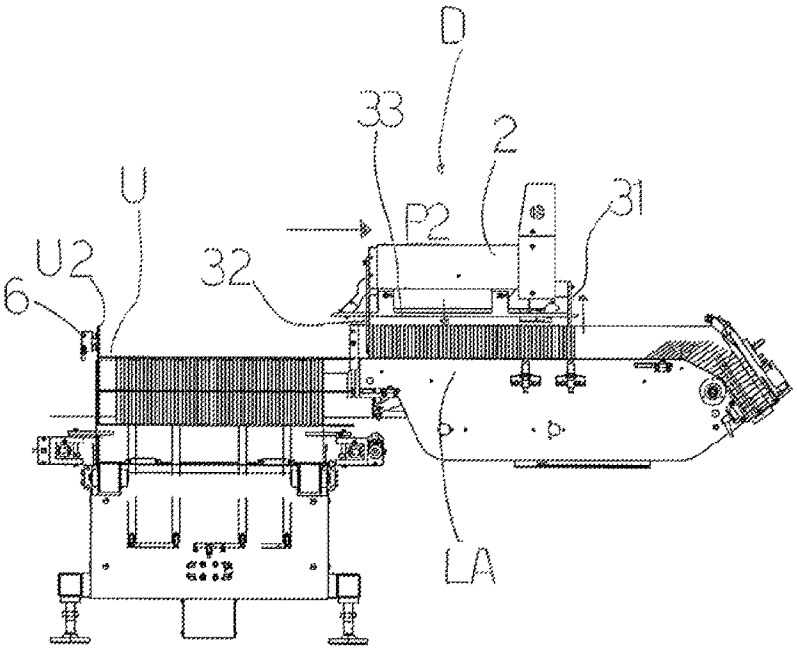
Figure 4C:
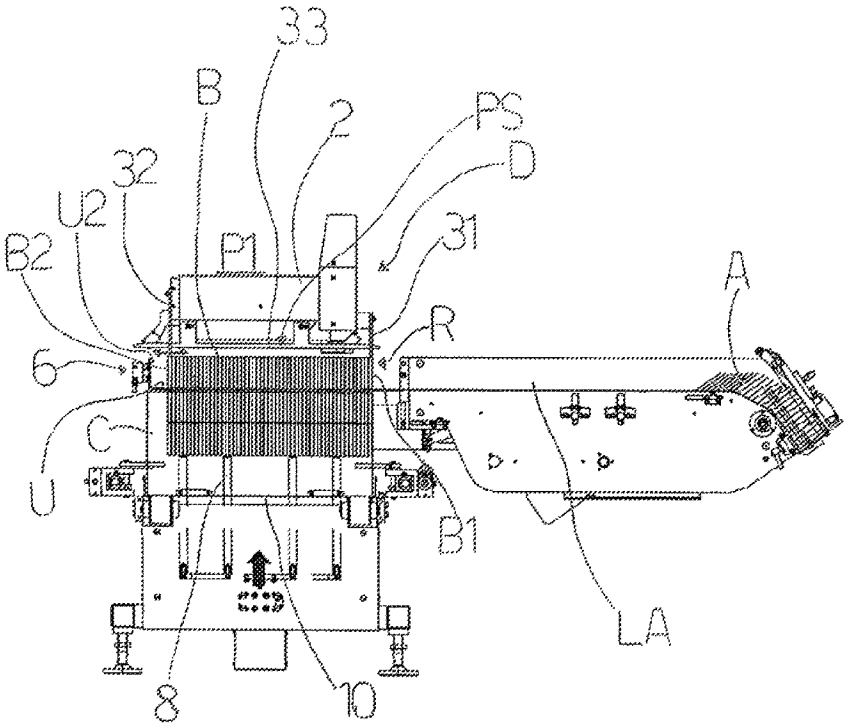
Figure 4F:
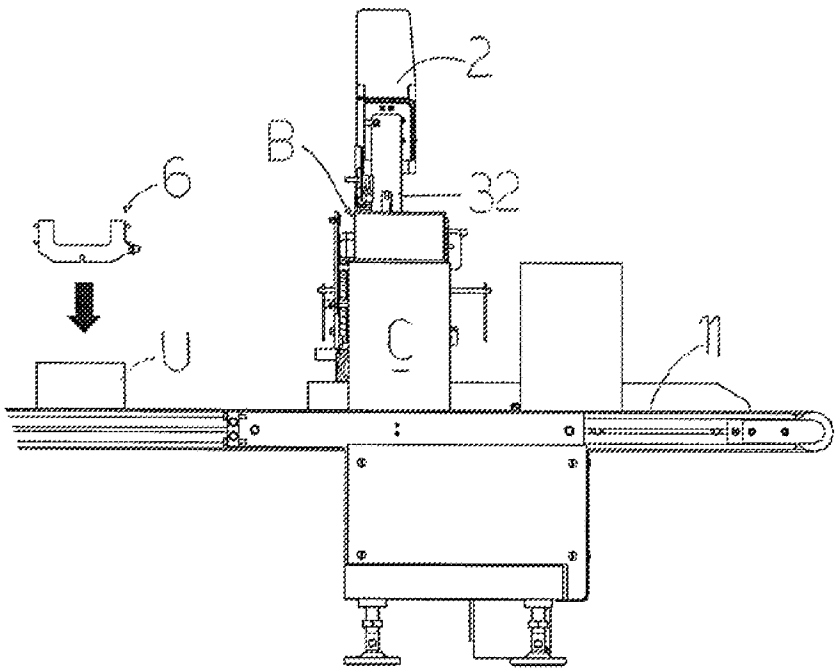
Figure 4E:
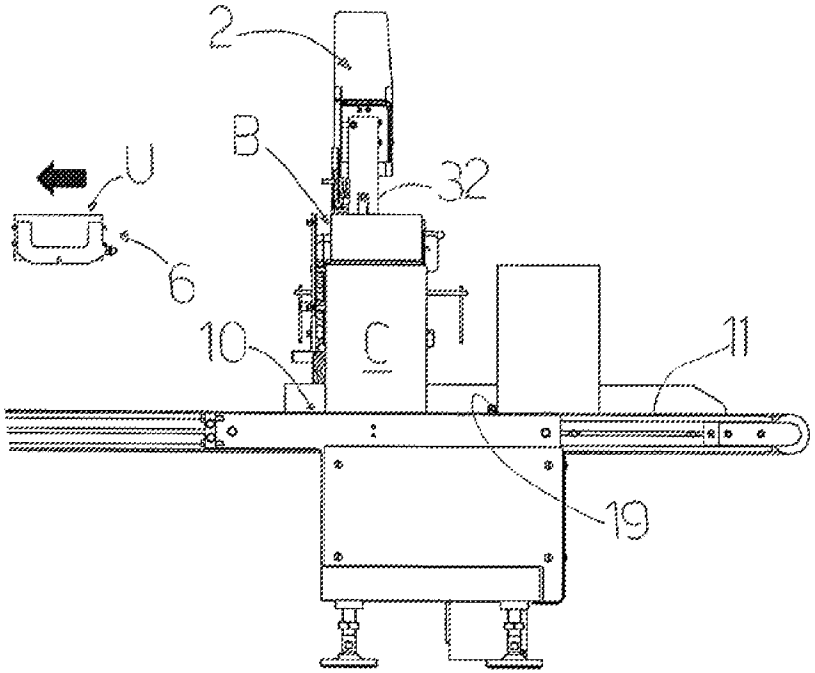
Figure 4G:
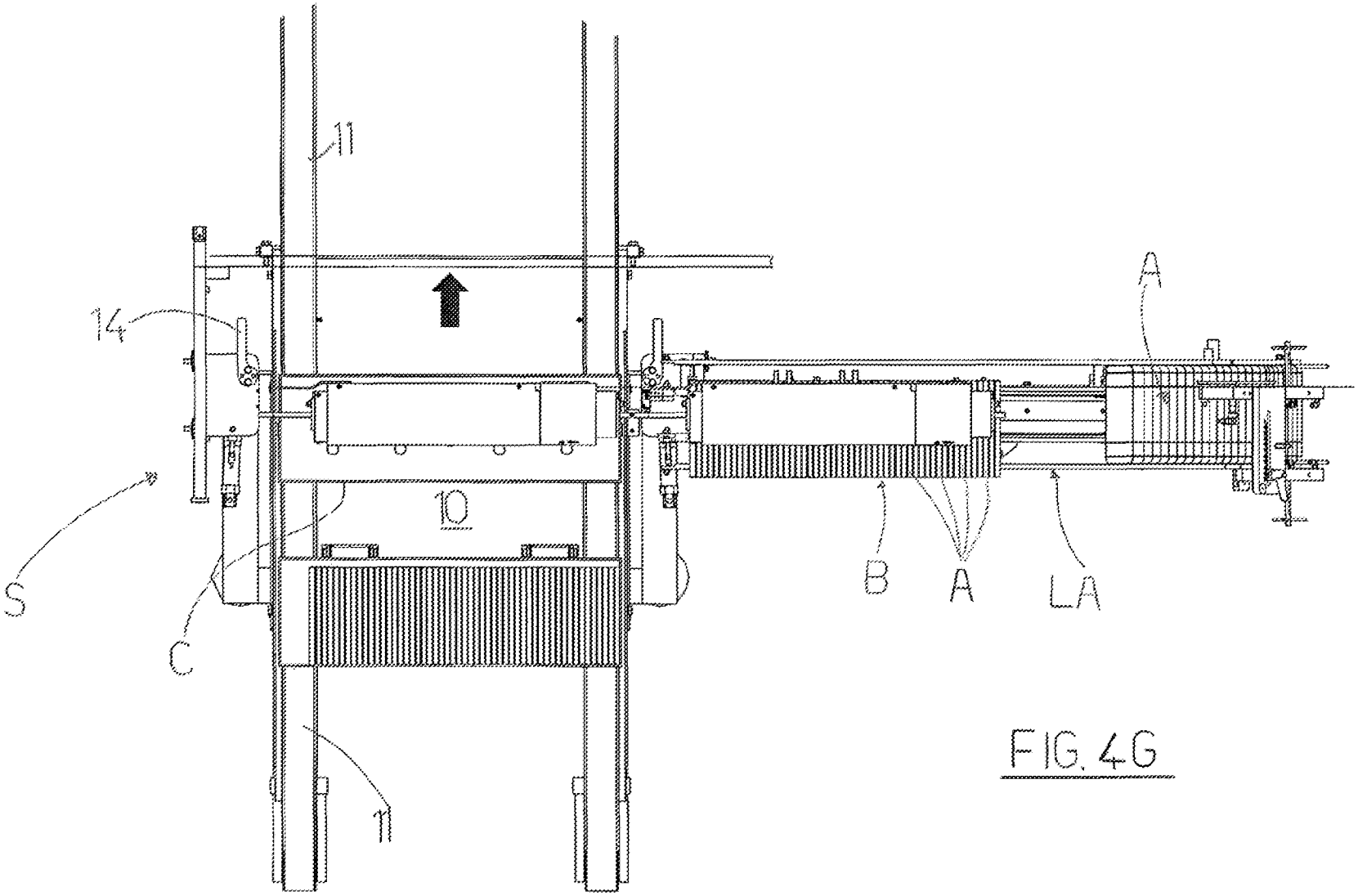

The transfer device (D) further comprises raising means (8), associated to the positioning station (1) of the carton (C), which are configured and predisposed so as, time by time, to raise the batteries (B) of boxes present internally of the carton (C) so that a battery (B) of boxes at a time is positioned in a waiting position (R) beyond the open upper face (I) of the carton (C) in front of the start of the inlet line (LA) of the boxing machine (MA) (see for example FIGS. 3B and 4C).

A first special characteristic of the transfer device (D) of the present invention consists in the fact that it further comprises a frame (2), which is predisposed so as to be activatable in translation above the positioning station (1) of the carton and the inlet line (LA) of the boxing machine (MA) between a first position (P1), in which the frame (2) is situated above the waiting position (R) in which the raising means (8) time by time raise a battery (B) of boxes beyond the open upper face (I) of the carton (C) (see FIGS. 2A, 2B, 3A, 3B), and a second position (P2) in which the frame (2) is situated above the inlet line (LA) of the boxing machine (MA) (see FIGS. 3C, 3D), and gripping means (31, 32), which are mounted and predisposed on the frame (2) so as to be activatable both for gripping and retaining a battery (B) of boxes at the two ends (B1, B2) thereof and for releasing the battery (B) of boxes.

Figure 3C:
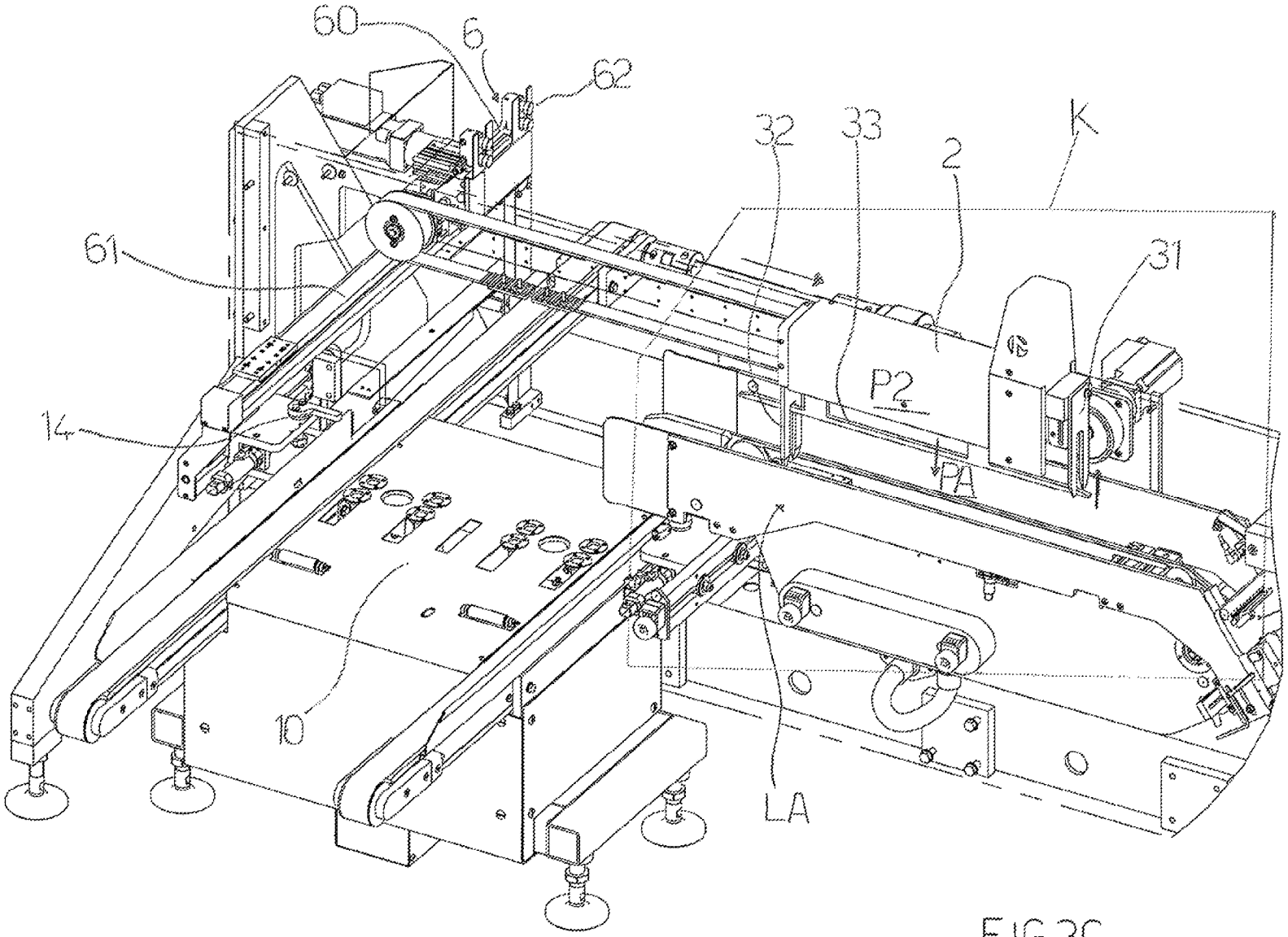
Figure 3D:
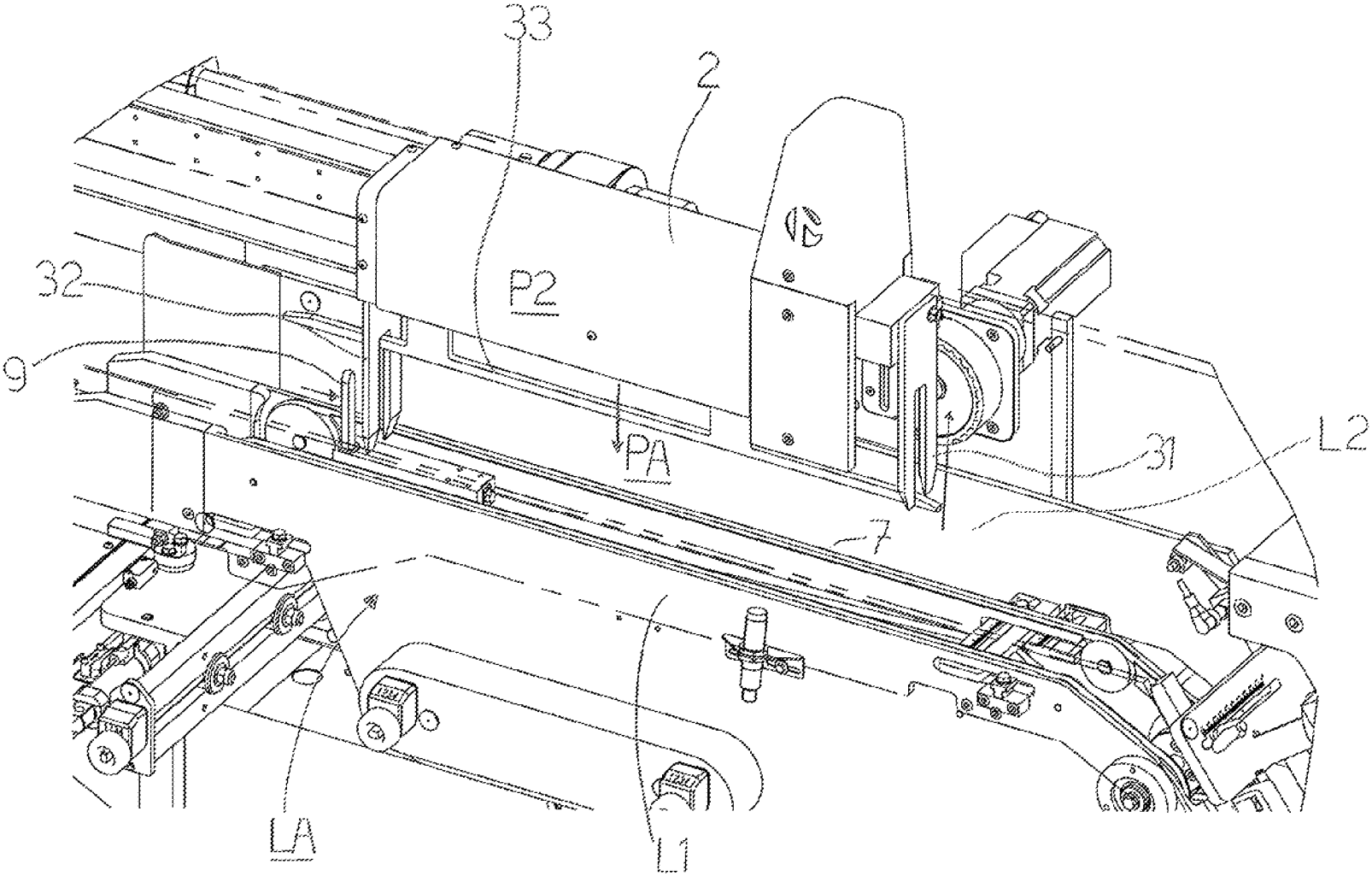
FIG. 3D is a larger-scale view of the detail denoted by letter K of FIG. 3C.

In particular, the gripping means (31, 32) are predisposed on the frame (2) in such a way that, when the frame (2) is in the first position (P1) above the waiting position (R), to be activatable both for gripping and retaining the battery (B) of boxes at the two ends (B1, B2) thereof, once the battery (B) of boxes is raised by the raising means (8) into the waiting position (R) (see for example FIGS. 3A, 3B and 4C), and are also predisposed in such a way, when the frame (2) is in the second position (P2) above the inlet line (LA), as to be activated for releasing the battery (B) of boxes into the inlet line (LA) (see for example FIGS. 3C, 3D and 4D).

In this way, the transfer device (D) is able to grip and retain the battery of boxes which time by time is raised by the raising means (8) into the waiting position (R) above the carton (C), and then transfer the battery to the inlet line (LA) of the boxing machine (MA), and then release the battery into the inlet line (LA).

These operations are carried out rapidly and effectively, and the battery of boxes of the battery of boxes are further kept mutually compact since the gripping means act on the two ends of the battery.

For example, the above-mentioned raising means (8) of the batteries of boxes in the waiting position (R) above the carton (C) can preferably be made according to what is described in European Patent Application no. EP2.671.808, in the name of the same Applicant, and comprising a series of vertically-mobile rods in such a way as to be able to cross the holes (F) present in the base wall (CB) of the carton (C) and thus push and raise the batteries (B) of boxes present therein upwards beyond the open upper face (I) and position, time-by-time, the batteries of boxes in the waiting position (R), in such a way that they can be transferred from the frame and the gripping means to the inlet line of the boxing machine.

In the preferred embodiment of the transfer device (D) of the invention, illustrated in the accompanying figures, the gripping means (31, 32) comprise a front gripping member (31) and a rear gripping member (32), the front gripping member (31) being provided for gripping and retaining the battery (B) of boxes at a first end (B1) thereof proximal to the inlet line (LA) and the rear gripping member (32) being instead provided for gripping and retaining the battery (B) of boxes at a second end (B2) thereof distal to the inlet line (LA).

In particular, the rear gripping member (32) is predisposed on the frame (2) so as to be translatable both distancingly and nearingly with respect to the front gripping member (31) so as to be able to increase or reduce the reciprocal distance thereof.

This specification is particularly advantageous for enabling gripping and retaining the battery of boxes at the two ends thereof.

In fact, when the frame (2) is translated into the first position (P1), the rear gripping member (32) is first translatable distancingly with respect to the front gripping member (31) so as to distance therefrom by a greater distance than a length of the batteries (B) of boxes present in the carton (C) in such a way that, when a battery (B) of boxes is raised by the raising means (8) into the waiting position (R), the battery (B) of boxes is situated between the rear gripping member (32) and the front gripping member (31), and thereafter the rear gripping member (32) is translatable nearingly to the front gripping member (31) so as to reduce the reciprocal distance thereof in order to be able to grip and block the battery (B) of boxes to one another at the two ends (B1, B2) of the battery (B) and maintain the battery (B) of boxes stably during the following translation of the frame (2) from the first position (P1) to the second position (P2) above the inlet line (LA).

In this way, the boxes of the battery will be kept compact with one another during transfer thereof to the inlet line (LA) of the boxing machine (MA).

In a further advantageous detail, the front gripping member (31) is predisposed on the frame (2) in such a way as to be raisable and lowerable with respect to the frame (2).

In this way, when the frame (2) is translated into the second position (P2) in order to transfer the battery (B) of boxes retained between the rear gripping member (32) and the front gripping member (31) at the inlet line (LA), the front gripping member (31) is raised so as to be able to release the first end (B1) of the battery (B) of boxes in order to enable a following advancing of the battery (B) of boxes along the inlet line (LA).

In fact, the inlet line (LA) of the boxing machine (MA) is usually provided with a pusher member (9) that is activatable to assume a raised position (visible in FIG. 3D) and lowered (for example see FIG. 3B in which the pusher member (9) is not visible as it is in a position below the belts (7)), and when brought into the raised position, the pusher member (9) serves to constitute a rear abutment for the second end (B2) of the battery of boxes once released on the inlet line (LA), and to accompany the boxes during the successive advancing thereof by means of the belts (7), preventing them from tilting backwards.

With the aim of keeping the boxes mutually compact once released on the inlet line (LA), the transfer device (D) also comprises a stabilising bar (33), which is predisposed on the frame (2) in such a way as to be arranged between the front gripping member (31) and the rear gripping member (32).

In particular, the stabilising bar (33) is predisposed on the frame (2) in such a way as to be movable between a raised position (PS) and a lowered position (PA).

In greater detail, the stabilising bar (33) is maintained in the raised position (PS) when the frame (2) is in the first position (P1) and up to when the frame (2) is translated into the second position (P2) in order to transfer the battery (B) of boxes into the inlet line (LA), (see for example FIGS. 3B, 4C), while the stabilising bar (33), when the frame (2) is in the second position (P2), in which the battery of boxes is released onto the inlet line (LA), is lowered into the lowered position (PA) (see for example FIGS. 3C, 3D and 4D) in order to abut the battery (B) of boxes in the inlet line (LA) so that, when the front gripping member (31) is raised, the stabilising bar (33) maintains the boxes (A) in position and compact with one another in the inlet line (LA).

For example, according to the embodiment illustrated in the figures, the front gripping member (31) and the rear gripping member (32) can be constituted by plates having a lower portion that is fork-conformed, the stabilising bar (33) being predisposed on the frame (2) and has a length that is such as to insert, by the extremities thereof, between the forks of the lower portions of the plates of the gripping members (31, 32).

This particular embodiment of the gripping members also enables the pusher member (9), once brought into the raised position, to be able to abut the end upstream of the battery of boxes (second end (B2) of the battery of boxes) passing between the fork-conformed portion of the rear gripping member (32); in this way there is no possibility that the boxes can tip over backwards during the positioning thereof in the inlet line (LA).

In a further and other advantageous aspect, the transfer device (D) can be provided with inclining means of the boxes (not illustrated in the accompanying figures) which are predisposed in such a way as to tilt the boxes, once positioned on the inlet line (LA), in a frontwards inclination, i.e. in such a way that the boxes assume an orientation with an acute angle with respect to the belts in the direction of the subsequent advancing thereof along the inlet line (LA).

This specification, i.e. the presence of the inclining means, is particularly advantageous as it enables arranging the boxes with a particular orientation in an optimal position for the functioning of the successive work stations of the boxing machine directed at opening out the boxes to full volume.

The above-mentioned positioning station (1) of the carton (C) comprises a rest plane (10), conveying means (11) of the carton (C) for conveying the carton (C) with the open upper face (I) above the rest plane (10) and maintaining means (14, 15) of the carton (C), for halting and keeping the carton (C) halted on the rest plane (10) in the halted position (PR) so that the raising means (8) can raise the batteries (B) of boxes with the carton (C) maintained stably stationary on the rest plane (10).

In particular, the rest plane (10) can comprise slots (17) for enabling passage of the rods of the raising means (8) of the batteries (B) of boxes present in the carton (C).

The maintaining means (14, 15) of the carton (C) comprise at least an abutting arm (14) mobile in rotation according to a vertical axis, activatable in rotation about the axis thereof in order to be arranged transversally with respect to the rest plane (10) in order to constitute a stop abutment for halting the carton (C) in the halted position (PR) on the rest plane (10).

The maintaining means (14, 15) of the carton (C) can further comprise suction means (15) which are predisposed in a lowered position below the rest plane (10) at special slots (16) present in the rest plane (10).

The suction organs (15), once the carton (C) has been halted in the halted position (PR), being movable into a raised position in order to be positioned at the slots (16) so as to abut the base wall (CB) of the carton (C) and thus retain the carton (C) in the halted position (PR) on the rest plane (10).

The transfer device (D) further comprises stop elements (19) of the cartons (C), situated on the rest plane (10) upstream of the halted position (PR) in which a carton (C) is halted by the maintaining means (14, 15) of the carton (C), predisposed to halt the cartons successively conveyed by the conveying means (11) towards the rest plane (10) while waiting for the carton (C) stopped in the halted position (PR) to be completely emptied.

These stop elements (19) can be for example constituted by idle rollers arranged with the rotation axis thereof transversal and perpendicular to the direction with which the conveying means (11) convey the cartons on the rest plane.

The conveying means (11) can for example be constituted by pairs of belts arranged parallel to one another.

The transfer device (D) is further provided with abutting means (6) of the containing flaps (U) of the batteries (B) of boxes, which are predisposed at the halted position (PR) of the carton (C), on the opposite side with respect to the inlet line (LA), in a position such as to be able to abut and retain a tab (U2) of the containing flap (U) of the battery (B) of boxes which is raised by the raising means (8) into the waiting position (R) above the open upper face (I) of the carton (C).

The abutting means (6) are movable, once the battery (B) of boxes has been transferred to the inlet line (LA) of the boxing machine (MA), so as to transport the containing flap (U) to an unloading station (see for example FIGS. 4C, 4D, 4E, 4F).

For example, in the particular embodiment illustrated in the figures, the abutting means (6) comprise a carriage (60) mobile along a sliding guide (61) and suction gripping means (62) mounted on the carriage (60) (see for example FIG. 3C).

In order to facilitate the grip of the tab (U2) of the containing flap (U) by the suction gripping means (62), the frame (2), once the gripping means (31, 32) have gripped the battery (B) of boxes at the two ends (B1, B2) thereof, and prior to being translated towards the second position (P2) above the inlet line (LA), can be slightly retracted and displaced towards the suction gripping means (62), thus retracting the battery of boxes (B) with respect to the containing flap (U), which will then, by friction, be displaced backwards towards the suction gripping means (62), facilitating the grip thereof on the tab (U2).

A further aspect of the present invention, as demonstrated in the foregoing, consists in providing a boxing machine for packaging blister packs having a particular lay-out as concerns the reciprocal predisposing between the infeed line (LC) of the blister packs and the inlet line (LA) which receives the flat boxes into which, once opened-out, the blister packs are to be inserted.

This particular lay-out enables the boxing machine to be provided and equipped with the transfer device described in the foregoing.

The particular lay-out of the boxing machine, as concerns the mutual arrangement of the infeed line (LC) of the blister packs and of the inlet line of the boxes (LA), and the presence and arrangement of the transfer device (D), is illustrated for example in FIGS. 2A, 2B, 2C and 3*a*.

On the basis of this lay-out the boxing machine (MA) comprises:

an inlet line (LA) in which flat boxes (A) are to be positioned for the successive advancing of the flat boxes (A) towards work stations for opening out the boxes to full volume, an infeed line (LC) of the blister packs which are to be inserted in the opened-out boxes, the infeed line (LC) being arranged flanked to the inlet line (LA) and having an extension and development that is greater than the inlet line (LA), wherein the infeed line (LC) is arranged parallel to the inlet line (LA) and at an elevated level with respect to the inlet line (LA) so as to identify an operating space (S) upstream of the start of the inlet line (LA) and below a section of the infeed line (LC), the boxing machine (MA) comprising a transfer device (D) according to the invention and as described in the foregoing, in which the positioning station (1) of the carton of the transfer device (D) is arranged at the operating space (S) and wherein the frame (2) of the transfer device (D) is predisposed in such a way as to be translatable parallel to the infeed line (LC).

With this particular lay-out, the raising operations of the batteries of boxes out of the carton and the following transfer of the batteries to the inlet line take place internally of the external frame (E) (see FIG. 2A) of the boxing machine (MA) and in a position that is perfectly visible and monitorable by the operators, who are in a position of complete safety externally of the external frame (E).

According to this particular lay-out, the transfer device (D) is positioned in the operating space (S) in such a way that the rest plane (10) of the positioning station (1) of the carton is at a lower height than the infeed line (LC) and the conveying means (11) of the positioning station (1), in order to convey the carton containing the batteries (B) of boxes to the rest plane (10), are arranged transversally to the infeed line (LC) so as to convey the cartons on the rest plane (10) in a transversal and perpendicular direction to the infeed line (LC).

The only part that can be projecting from the external frame (E) is the part relative to the initial part of the conveying means (11) of the carton, on which, in a state of complete safety, the operator can arrange and rest a carton containing the boxes with the upper face open.

The conveying means (11) can be predisposed and have an extension such as to transfer the carton, once emptied of the batteries of boxes, from the rest plane (10) towards an unloading station, situated on the opposite side of the boxing machine (MA) with respect to the point in which the operator deposits the carton on the conveying means (11), causing the empty carton to transit below and beyond the infeed line (LC).

The above has been described by way of non-limiting example and any technical-functional variants are considered to fall within the protective scope of the following claims.

The invention claimed is:

1. A transfer device for transferring flat boxes contained internally of a carton to an inlet line of a boxing machine, comprising:

a positioning station of a carton, for receiving a carton with a relative upper face open and internally containing flat boxes which are predisposed, neared and flanked to one another, to form batteries of boxes which are arranged one above another internally of the carton and each contained internally of a relative support sheet, the positioning station being predisposed with respect to the inlet line of the boxing machine so as to receive the carton and to halt the carton in a halted position with a relative transversal wall facing towards the inlet line and with the open upper face in front of and substantially at a same level as a start of an inlet line;

raising means, associated to the positioning station of the carton, which are configured and predisposed so as, time by time, to raise the batteries of boxes present internally of the carton so that a battery of boxes at a time is positioned in a waiting position beyond the open upper face of the carton in front of the start of the inlet line of the boxing machine;

a frame predisposed so as to be activatable in translation above the positioning station of the carton and the inlet line of the boxing machine between a first position, wherein the frame is situated above the waiting position in which the raising means time by time raise a battery of boxes beyond the open upper face of the carton, and a second position in which the frame is situated above the inlet line of the boxing machine; and gripping means mounted and predisposed on the frame so as to be activatable both for gripping and retaining a battery of boxes at the two ends thereof and for releasing the battery of boxes, the gripping means are predisposed on the frame in such a way that, when the frame is in the first position above the waiting position, to be activatable for gripping and retaining the battery of boxes at the two ends thereof, once the battery of boxes is raised by the raising means into the waiting position, and are also predisposed in such a way, when the frame is in the second position above the inlet line, as to be activated for releasing the battery of boxes into the inlet line, wherein the positioning station of the carton comprises a rest plane, conveying means for conveying the carton with the open upper face above the rest plane and maintaining means for halting and keeping the carton halted on the rest plane in the halted position so that the raising means can raise the batteries of boxes with the carton maintained stably stationary on the rest plane, further comprising stop elements of the cartons, situated on the rest plane upstream of the halted position in which a carton is halted by the maintaining means of the carton, predisposed to halt the cartons successively conveyed by the conveying means towards the rest plane while waiting for the carton stopped in the halted position to be completely emptied.

2. The transfer device of claim 1, wherein the gripping means comprise a front gripping member and a rear gripping member, the front gripping member being provided for gripping and retaining the battery of boxes at a first end thereof proximal to the inlet line and the rear gripping member being provided for gripping and retaining the battery of boxes at a second end thereof distal to the inlet line, wherein the rear gripping member is predisposed on the frame so as to be translatable both distancingly and nearingly with respect to the front gripping member so as to be able to increase or reduce the reciprocal distance thereof so that, when the frame is translated into the first position, the rear gripping member is first translatable distancingly with respect to the front gripping member so as to distance therefrom by a greater distance than a length of the batteries of boxes present in the carton in such a way that, when a battery of boxes is raised by the raising means into the waiting position, the battery of boxes is situated between the rear gripping member and the front gripping member, and thereafter the rear gripping member is translatable nearingly to the front gripping member so as to reduce the reciprocal distance thereof in order to grip and block the battery of boxes to one another and maintain the battery of boxes stably during the following translation of the frame from the first position to the second position above the inlet line.

3. The transfer device of claim 2, wherein the front gripping member is predisposed on the frame in such a way as to be raisable and lowerable with respect to the frame, so that when the frame is translated into the second position in order to transfer the battery of boxes retained between the rear gripping member and the front gripping member at the inlet line, the front gripping member is raised so as to be able to release the first end of the battery of boxes in order to enable a following advancement of the battery of boxes along the inlet line.

4. The transfer device of claim 3, further comprising a stabilising bar, predisposed on the frame in such a way as to be arranged between the front gripping member and the rear gripping member, the stabilising bar being predisposed on the frame in such a way as to be movable between a raised position and a lowered position, the stabilising bar being maintained in the raised position when the frame is in the first position and up to when the frame is translated into the second position in order to transfer the battery of boxes into the inlet line, and the stabilising bar, when the frame is in the second position, being lowered into the lowered position in order to abut the battery of boxes in the inlet line so that, when the front gripping member is raised, the stabilising bar maintains the boxes in position and compact with one another in the inlet line.

5. The transfer device of claim 4, wherein the front gripping member and the rear gripping member are constituted by plates having a lower portion that is fork-conformed and in that the stabilising bar is predisposed on the frame and has a length that is such as to insert, by the extremities thereof, between the forks of the lower portions of the plates of the gripping members.

6. The transfer device of claim 1, wherein the maintaining means of the carton comprise at least an abutting arm movable in rotation according to a vertical axis, activatable in rotation about the axis thereof in order to be arranged transversally with respect to the rest plane in order to constitute a stop abutment for halting the carton in the halted position on the rest plane.

7. The transfer device of claim 6, wherein the maintaining means of the carton further comprise suction means which are predisposed in a lowered position below the rest plane at special slots present in the rest plane, the suction means, once the carton has been halted in the halted position, being movable in a raised position in order to be positioned at the slots so as to abut the base wall of the carton and thus retain the carton in the halted position on the rest plane.

8. A transfer device for transferring flat boxes contained internally of a carton to an inlet line of a boxing machine, comprising:

a positioning station of a carton, for receiving a carton with a relative upper face open and internally containing flat boxes which are predisposed, neared and flanked to one another, to form batteries of boxes which are arranged one above another internally of the carton and each contained internally of a relative support sheet, the positioning station being predisposed with respect to the inlet line of the boxing machine so as to receive the carton and to halt the carton in a halted position with a relative transversal wall facing towards the inlet line and with the open upper face in front of and substantially at a same level as a start of an inlet line;

raising means, associated to the positioning station of the carton, which are configured and predisposed so as, time by time, to raise the batteries of boxes present internally of the carton so that a battery of boxes at a time is positioned in a waiting position beyond the open upper face of the carton in front of the start of the inlet line of the boxing machine;

a frame predisposed so as to be activatable in translation above the positioning station of the carton and the inlet line of the boxing machine between a first position, wherein the frame is situated above the waiting position in which the raising means time by time raise a battery of boxes beyond the open upper face of the carton, and a second position in which the frame is situated above the inlet line of the boxing machine;

gripping means mounted and predisposed on the frame so as to be activatable both for gripping and retaining a battery of boxes at the two ends thereof and for releasing the battery of boxes, the gripping means are predisposed on the frame in such a way that, when the frame is in the first position above the waiting position, to be activatable for gripping and retaining the battery of boxes at the two ends thereof, once the battery of boxes is raised by the raising means into the waiting position, and are also predisposed in such a way, when the frame is in the second position above the inlet line, as to be activated for releasing the battery of boxes into the inlet line; and abutting means of the support sheets of the batteries of boxes, predisposed at the halted position of the carton, on the opposite side with respect to the inlet line, in a position such as to be able to abut and retain a tab of the support sheet of the battery of boxes which is raised by the raising means into the waiting position above the open upper face of the carton, the abutting means being movable, once the battery of boxes has been transferred to the inlet line of the boxing machine, so as to transport the support sheet to an unloading station.

9. The transfer device of claim 8, wherein the abutting means comprise a carriage movable along a sliding guide and suction gripping means mounted on the carriage.

* * * * *